United States Patent [19]

Toyoda et al.

[11] Patent Number: 4,489,291

[45] Date of Patent: Dec. 18, 1984

[54] CIRCUIT BREAKER PROVIDED WITH PARALLEL RESISTOR

[75] Inventors: Mitsuru Toyoda, Yokohama; Eiichi Haginomori, Tokyo; Masanori Ishimatsu, Fussa; Tsutomu Okutomi, Yokohama, all of Japan

[73] Assignee: Tokyo Shibaura Denki Kabushiki Kaisha, Kawasaki, Japan

[21] Appl. No.: 428,968

[22] Filed: Sep. 30, 1982

[30] Foreign Application Priority Data

| | | | |
|---|---|---|---|
| Oct. 12, 1981 | [JP] | Japan | 56-160954 |
| Dec. 28, 1981 | [JP] | Japan | 56-210039 |
| Mar. 19, 1982 | [JP] | Japan | 57-42974 |

[51] Int. Cl.[3] ..... H01C 10/50

[52] U.S. Cl. ..... 338/200; 200/144 AP; 338/215

[58] Field of Search ..... 338/70, 200, 61, 215; 200/144 AP

[56] References Cited

U.S. PATENT DOCUMENTS

| | | | |
|---|---|---|---|
| 3,763,340 | 10/1973 | Noack | 200/144 AP X |
| 3,766,510 | 10/1973 | Quinn | 338/20 |
| 3,811,103 | 5/1974 | Matsuoka et al. | 338/20 |
| 4,213,113 | 7/1980 | Brandt et al. | 338/165 X |
| 4,265,844 | 5/1981 | Yokomizo et al. | 338/20 X |

*Primary Examiner*—C. L. Albritton

*Attorney, Agent, or Firm*—Oblon, Fisher, Spivak, McClelland & Maier

[57] ABSTRACT

A circuit breaker fitted with a parallel resistor and provided with main contacts and resistor contacts arranged electrically in parallel with the main contacts wherein the resistor is formed of a material selected from the group consisting of Cr, CrN, $Cr_3C_2$, CrB, NiO and Mgo. The resistor element generally is made of a material in which the product of the specific heat expressed in Cal/g°C. with the density expressed in g/cm$^3$ is at least 0.7.

4 Claims, 4 Drawing Figures

CIRCUIT BREAKER PROVIDED WITH PARALLEL RESISTOR

BACKGROUND OF THE INVENTION

1. Field of the Invention

This invention relates to circuit breakers provided with main contacts and, in parallel therewith, resistance contacts, and in particular relates to circuit breakers fitted with a parallel resistor having improved resistance contacts.

2. Description of the Prior Art

Use is made, for example, in switchgears of power circuit breakers, or systems in which, as shown in FIG. 1, there are provided main contacts 1 and, electrically in parallel therewith, resistance contacts 2, the resistance being inserted in the circuit when the main contacts 1 are closed or when they are opened. This is for various reasons, which include the need to restrict abnormal voltages which are produced during switching, or to raise the switching capability of the contacts by limiting the rate of rise and the peak value of the voltage which is generated between the contacts after circuit-breaking. By the use of such a system not only can the abnormal overvoltages be suppressed, but also the life of the main contacts 1 can be increased and the reliability of the device can be improved.

A resistor material which was previously used to meet this objective used $Al_2O_3$ replaced by $SiO_2$ or the like. However, with the trend to larger capacity switchgear units, the parallel resistor also becomes larger, which militates against the trend to improved compactness of the device.

The resistance of the resistor is determined by the circuit to which it is applied and the overall application, but to suppress overvoltages generated when the main contacts are closed, it is necessary to make the resistance comparatively low (on the order of several hundred ohms). The heat which is generated by the resistor is proportional to the square of the applied voltage and inversely proportional to the resistance. Thus, if the voltage is high, an enormous amount of heat is generated by the resistor when the current is passed. Since this heat is generated instantaneously, it cannot be expected that it will be radiated from the resistor, and so it accumulates in the resistor material. In general the permissable rise in temperature of the switchgear has a limit, and if the temperature rises beyond this, the material swells up or becomes weakened, causing a deterioration in its electrical and mechanical properties and a decline in insulation strength. To control the rise in temperature of the switchgear, therefore, conventional resistors were of large volume, resulting in a large device being necessary.

SUMMARY OF THE INVENTION

Accordingly, one object of this invention is to provide a novel circuit breaker provided with main contacts and in parallel therewith resistance contacts defining an improved resistance structure and composition.

Another object of the present invention is to improve the main constituents of the resistive material of which the resistance contacts are composed.

These and other objects are achieved according to the invention by providing a resistor of chromium-containing ceramics material, this ceramics containing at least 30 wt % of at least one compound selected from $Cr_2N$, $Cr_3C_2$, $CrB_2$, $Cr_2O_3$, NiO, and MgO. The resistor further contains a resistance adjusting material which is C, Si, B or the like semi-metal added to the main constituent, for example $Cr_2N$, $Cr_3C_2$, and the like.

The resistor of the invention includes a power regulating element made of a material of which the product of its specific heat, expressed in Cal/g. °C. and its density, expressed in $g/cm^3$, is at least 0.7.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
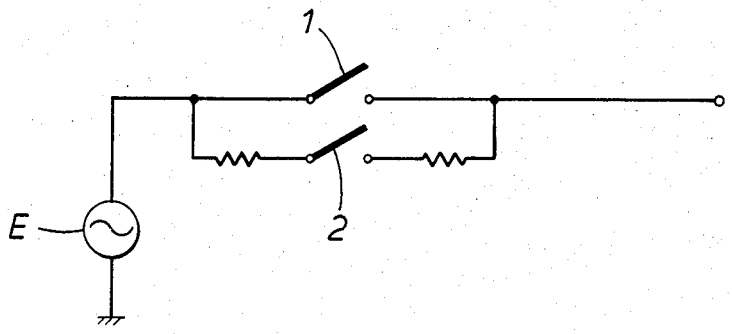
FIG. 1 is a circuit drawing explaining the electrical circuit.
Figure 2:
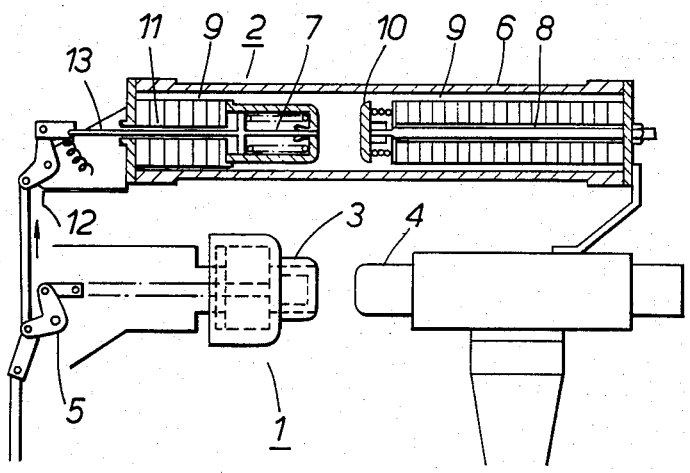
FIG. 2 is a schematic diagram, partly in cross-section, showing an embodiment of this invention.

Referring now to the drawings, wherein like reference numerals designate identical or corresponding parts throughout the several views, and more particularly of FIG. 2 thereof, FIG. 2 shows an example of a circuit breaker fitted with a parallel resistance according to this invention. The main contacts 1, forming a puffer-type arc extinguisher, consist of a movable contact 3 and fixed contact 4. The movable contact 2 is driven by a drive device, not shown, through a like mechanism 5.

Resistance contacts 2 are connected electrically in parallel with the main contacts 1. The resistance contacts 2 consist of a movable contact 7 that is supported inside an insolating tube 6, and a fixed contact 10 electrically connected with a resistor 9 at the tip of an insulating support rod 8. The movable contact 7 is electrically connected to the resistor 9 that is supported by a hollow insulating support rod 11, and is driven by an operating rod 13 formed of an insulator and link mechanism 12 which is linked for joint movement with the link mechanism 5 of the main contacts 1. The resistor 9 is formed by placing a plurality of plate resistance elements face-to-face. The flat surfaces of these resistance elements are covered with metal to confer contact stability. They may be arranged in series in view of the resistance and withstand-voltage requirements of the circuit to which they are applied, or in parallel for withstand-energy requirements. The temperature rise $\Delta T$ of the resistor 9 is dependent on the amount of head generated Q, and is inversely proportional to the resistance volume V. If we let the heat capacity be a, we have the following relationship:

$$\Delta T \propto Q/aV$$

wherein $a \equiv c \cdot \rho$, c being the specific heat, and $\rho$ being the density. That is, if Q is kept constant by making the resistance and applied voltage constant, making the volume V smaller causes an increase in $\Delta T$, but the increase in $\Delta T$ can be suppressed by increasing the value of a. The temperature rise (ΔT) of the elements is dependent on the amount of heat (Q) which is generated and is inversely proportional to the total number of elements and their volume, so if the heat capacity per unit resistor element is multiplied by a factor b, the amount of energy that can be absorbed, Q, for the same rise in temperature ΔT is also multiplied by b. For the same Q and ΔT, the volume of the element can be reduced by 1/b, and the object of this invention, namely, increased heat capacity of the elements and compactness, can be achieved.

Figure 3:
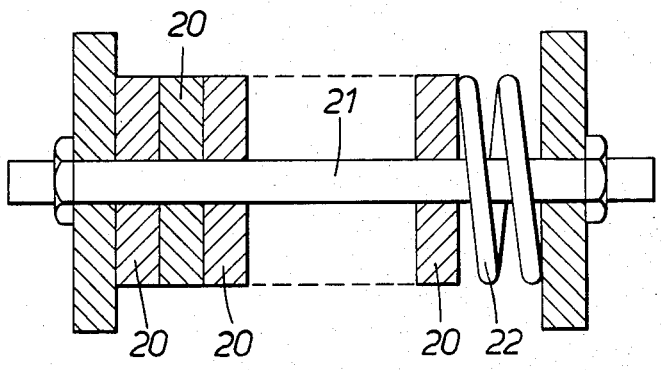
FIG. 3 is a cross-sectional view of a resistor element having doughnut-shaped elements.
Figure 4:
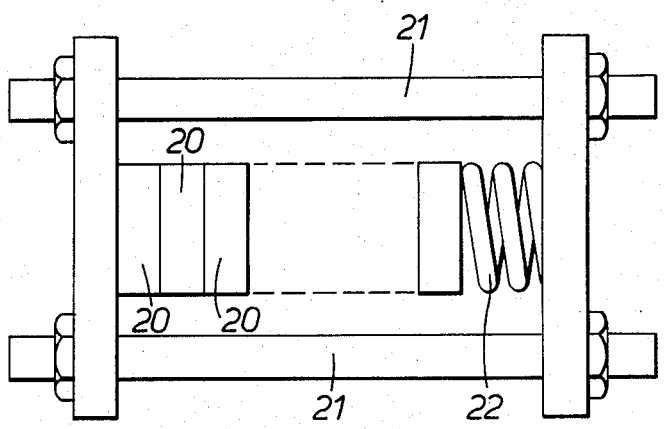
FIG. 4 is a cross-sectional view of a resistor element having disc-shaped elements.

A resistor element according to this invention is explained in detail with reference to the accompanying drawings. The elements 1, which may be of doughnut shape as shown in FIG. 3, or disc-shaped as shown in FIG. 4, are held by a supporting pillar 21 of insulating material and subjected to suitable pressure through an elastic body 22. The elements 22 may be arranged in series to satisfy the resistance and withstand-voltage requirements of the circuit to which they are applied, or may be arranged in parallel to satisfy withstand-energy requirements. The surfaces of the elements have a metal covering to provide contact stability between the elements.

The invention is explained below with reference to Examples.

The producing process of $Cr_2O_3$ (remainder)+MgO (10 wt %)+NiO (20 wt %) as shown in No. 2 in Table 1 is explained as follows. The producing method of the other embodiments shown in Tables 1 and 2 is same as that No. 2 in Table 1.

In a ball mil., 7000 g of chromium oxide ($Cr_2O_3$), 100 g of magnesium oxide (MgO), and 2000 g nickel oxide (NiO) were well-blended for 12 hours. The lack grain of above-described constitutent is 325 mesh. Some paraffin was added to the mixture which result in containing 1% paraffin by weight. The mixture forms moldings having a diameter of 15 cm and a thickness of 2.2 cm by a pressure of 1 ton per square cm. The moldings were sintered at 1350° C. in air for 2 hours. Both end faces of the disc-shaped element have argentum coating and are sintered at 700° C. in air for 15 minutes, and the electrodes are attached on both sides of the resistor element. The 100 resistor elements produced as above described are connected in series. This was employed in a circuit at 550 V, for an insertion time of 10 ms. The test was carried out at room temperature in all cases.

TABLE 1

| No. | Material | Heat Capacity (cal/cm$^3$ °C.) | Temperature rise ΔT (°C.) of the element after passage of current |
|---|---|---|---|
| 1 | $Cr_2O_3$ | 0.83 | 63 |
| 2 | $Cr_2O_3$ + 10 w % MgO + 20 w % NiO | 1.0 | 63 |
| 3 | $Cr_2O_3$ + 40 w % MgO + 20 w % NiO | 0.91 | 69 |
| 4 | $Cr_2O_3$ + 69 w % $ZrO_2$ + 0.8 w % C | 0.87 | 73 |
| 5 | $Cr_2O_3$ + 25 w % $Al_2O_3$ + 1 w % C | 0.76 | 83 |
| 6 | $Cr_2O_3$ + 2 w % $TnO_2$ + 1 w % boron | 1.18 | 55 |
| 7 | $Cr_2O_3$ + 5 w % Si | 1.3 | 49 |
| 8 | $Cr_2O_3$ + 15 w % FeO | 0.70 | 71 |
| 9 | $Cr_2O_3$ + 5 w % NiO | 0.84 | 61 |
| 10 | $Cr_3C_2$ | 0.79 | 56 |
| 11 | $Cr_3C_2$ + 2 w % Si | 0.83 | 77 |
| 12 | $Cr_3C_2$ + 20 w % $SiO_2$ | 0.80 | 80 |
| 13 | $Cr_3C_2$ + 70 w % (2MgO—$SiO_2$) | 0.70 | 91 |
| 14 | $Cr_2N$ + 20 w % $Al_2O_3$ | 0.90 | 71 |
| 15 | $Cr_2N$ + 1 w % C | 0.91 | 59 |
| 16 | $CrB_2$ + 20 w % MgO | 0.93 | 68 |
| 17 | MgO + 2 w % C | 0.70 | 92 |
| 18 | MgO + 20 w % $SiO_2$ + 2 w % C | 0.67 | 94 |
| 19 | NiO + 1 w % C | 0.95 | 51 |
| 20 | NiO + 20 w % $SiO_2$ + 2 w % C | 0.74 | 85 |
| 21 | NiO + 60 w % MgO + 2 w % C | 0.73 | 87 |
| 22 | $Fe_2O_3$ + 1 w % C | 0.73 | 68 |
| 23 | MnO + 2 w % C | 0.76 | 67 |

TABLE 2

| No. | Material | Heat Capacity: a (cal/cm$^3$:c) | Temperature rise ΔT (°C.) of the element after passage of current |
|---|---|---|---|
| 24 | $Cr_2O_3$ + 80 w % $Al_2O_3$ + 2 w % C | 0.58 | 111 |
| 25 | $Cr_2O_3$ + 80 w % $SiO_2$ | 0.60 | 106 |
| 26 | $Al_2O_3$ + 2 w % C | 0.53 | 120 |
| 27 | $Al_2O_3$ + 2 w % $SiO_2$ + 2 w % C | 0.59 | 108 |
| 28 | AlN + 20 w % $Al_2O_3$ + 2 w % C | 0.56 | 114 |
| 29 | AlN + 2 w % C | 0.51 | 111 |
| 30 | MgO + 80 w % $SiO_2$ + 2 w % C | 0.53 | 119 |
| 31 | NiO + 80 w % $SiO_2$ + 2 w % C | 0.48 | 133 |
| 32 | $SnO_2$ + 2 w % C | 0.56 | 118 |
| 33 | SiC + 2 w % C | 0.51 | 114 |
| 34 | $ZrB_2$ + 20 w % CaO | 0.61 | 104 |

Examples 1 to 23 as shown in Table 1 belong to the scope of this invention and the examples 24–34 as shown in Table 2 do not belong to the scope of this invention. The resistor element as shown Example 1 which consists of pure chromium oxide ($Cr_2O_3$) shows the temperature rise ΔT of 63° C. The resistor elements as shown Example 2–9 contain 3 to 70 wt % of at least MgO, $ZrO_2$ and the like in addition to the major constituent $Cr_2O_3$. The temperature rise ΔT of these Examples are more than that of the Example 1 with the exception of examples 6, 7 and 9. The resistor of Example 24 which is out of scope of this invention contains more than 80 by weight of $Al_2O_3$ and 2% by weight of C and the like in addition to major constitutent $Cr_2O_3$. The temperature rise ΔT of the Example 24 is 111° C. Accordingly, it is desirable that the resistor element contains more than 30% by weight of chromium oxide ($Cr_2O_3$).

The resistor element as shown Example 10 consists of pure chromium carbon ($Cr_3C_2$). The temperature rise ΔT of this Example is 56° C. The resistor elements as shown in Examples 11–13 contains 20 to 70% by weight of Si, $SiO_2$ in addition to the major constitutent $Cr_3C_2$. The temperature rise of these Examples is higher than that of Example 10.

The Example 25 which is out of scope of this invention contains 80% by weight of silicon oxide ($SiO_2$) in addition to $Cr_3C_2$. The temperature rise of this Example is 106° C. Accordingly, it is necessary that resistor element contains more than 30% by weight chromium carbon ($Cr_3C_2$). As is shown by Examples 10 to 13, 25 there is a clear difference beween these, which contain at least 30 wt % of $Cr_3C_2$, and reference resistor element, which contains 20 wt %. As described above, there is also a clear difference between the examples containing at least 30 wt % of $Cr_3O_2$ and reference resistor element which contains 20 wt %. The resistor element which contains more than 30% by weight of $Cr_2N$ as shown by Examples 14 and 15, and $CrB_2$ as shown by Example 16 as a major constituent have a low temperature rise. The resistor elements which contain 30% by weight of $Cr_3Zr$, $CrSi_2$, $Cr_3Si_2$, $Cr_2S_3$, $Cr_3P$ as major constituents have a same effect as described above.

With regards MgO, as can be seen by comparing the Examples 17 and 18 which are within the scope of the this invention and Example 30 which is out of the scope of this invention, the temperature rise of the resistor element which contains less than 30% by weight of MgO is higher than that of the resistor element which contains more than 30% by weight of MgO.

With regards to NiO, as can be seen by comparing the Example 19 which is within the scope of this invention and Example 31 which is out of the scope of this invention, the temperature rise of the resistor element which contains less than 30% by weight of NiO is higher than that of the resistor element which contains more than 30% by weight of NiO.

With regards to N, B the same effect as described above are expected.

As can be seen by comparing the above comparative Tables 1 and 2, the type of material used for the elements appears as a difference in the temperature rises. This shows that the selection of the material to achieve the object of this invention is a very important factor. The specific heat of the $Al_2O_3$ which was the main material used previously is 0.14 Cal/g. °C., and its density is 3.8 g/cm$^3$, giving a product a of 0.53. In constrast, the specific heat of $Cr_2O_3$ is 0.16 Cal/g. °C., and its density is 5.2, giving a product a of 0.83. It can be seen that in the latter case, that of $Cr_2O_3$, the product a is about 60% larger. This shows that $Cr_2O_3$, of which the heat capacity, i.e., the product of the specific heat and the density, is the larger, per unit, is better than $Al_2O_3$ for the object of this invention, namely, of realizing an element of large heat capacity but small volume.

The results obtained for several materials are shown in Table 1. It can be seen that those materials whose heat capacity is greater than 0.7 show temperature characteristics which are referable in practical use. In general, with materials which have a heat capacity of at least 0.7, a satisfactory temperature characteristic for practical use is obtained. The object of this invention can therefore be achieved by the use of materials containing Cr, such as $Cr_3C_2$, $Cr_2N$, or $CrB_2$ to obtain resistance elements of large heat capacity but small volume. Concerning the lower limit of the content thereof, as can be seen from reference examples 24 and 25 at 20 wt % the effect is low, so at least 30 wt %, as in examples 1 to 16 is necessary. For the purposes of adjustment of the sintering conditions, mechanical properties or electrical resistance, other Cr compounds, e.g. $Cr_2Zr$, $CrSi_2$, $Cr_3Si_2$ or $Cr_2S_3$, $Cr_2O_3$, $Cr_3P$, etc may be admixed to obtain a similar effect.

Many insulating materials are used in the interior of switchgears, but epoxy resins or glass fibers impregnated with epoxy resin are often used where mechanical strength is required. The allowed temperatures for satisfactory electrical strength and mechanical strength are generally about 120° C. in the case of the former and 200° C. in the case of the latter. Assuming that the temperature rise for one duty is about 80°–100° C. and the temperature in the neighborhood of the element due to passage of current before this element was inserted is about 40° C. (typical measured values), the after-duty temperature will be 120° C.–140° C. The present situation is therefore that the only insulating material that can be used is epoxy-impregnated glass fiber. However, this is inferior in electrical properties to epoxy resin, and, since it is a composite material, there are problems in respect of product stability such as the presence of voids, and its reliability is inferior to epoxy resin. Thus as shown in Table 1 if an element whose heat capacity is at least 0.7 is used, the temperature rise ΔT can be 50° C.–70° C., so the temperature in the neighborhood of the element is 90° C.–110° C. Thus not only can the element be made compact, but in addition there is the further advantage that epoxy resin can be used.

The total resistance of all the elements varies depending on the relevant circuit conditions. However, even in the case of $Al_2O_3$, whose resistivity is $10^{13-15}\Omega$ cm, the required resistance can easiliy be obtained by admixture of several % of carbon. The resistance of the element material of this invention can likewise be adjusted by adding semi-metals such as silicon or boron, apart from carbon as mentioned above. Apart from addition of semi-metals, the resitivity may be freely adjusted by combination with oxides, borides, silicides, or nitrides, etc. As shown in example 9, a resistivity of 1~2 Ωcm can be obtained by the addition of 1% NiO to $Cr_2O_3$, which has a resistivity of about 15 Ωcm , or a resistivity of 0.7 Ωcm by 5% NiO addition. Apart from this, the resistance can of course be adjusted by means of grain size, forming pressure, sintering temperature, time residual porosity, and particle shape.

As explained in detail above, by means of this invention a heat absorbing element can be provided which has the same volume as was previously used but which can absorb a large amount of heat, so making it possible to make the device more compact.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit breaker fitted with a parallel resistor and provided with main contacts and resistor contacts that are arranged electrically in parallel with the said main contacts, comprising:

said resistor including at least one of NiO and MgO present in an amount of at least 30 wt %.

2. A circuit breaker according to claim 1, wherein said resistor includes a resistance adjusting material consisting of C, Si or B.

3. A circuit breaker fitted with a parallel resistor and provided with main contacts, and resistor contacts that are arranged electrically in parallel with the said main contacts, wherein said resistor is made of a material in which the product of the specific heat expressed in Cal/g °C. with density expressed in $g/cm^3$ is at least 0.7.

4. A circuit breaker fitted with a parallel resistor and provided with main contacts and resistor contacts that are arranged electrically in parallel with said main contacts, comprising:

a resistor including ceramics containing at least 30 wt % of at least one of $Cr_2N$, $Cr_2O_3$, $Cr_3C_2$ and $CrB_2$.

* * * * *